US005501521A

United States Patent [19]

Hjalmarson

[11] Patent Number: 5,501,521

[45] Date of Patent: Mar. 26, 1996

[54] MIXING APPARATUS FOR TEST TUBES

[76] Inventor: Hilda B. Hjalmarson, Becksjudarvägen 31, III, Nacka 131 36, Sweden

[21] Appl. No.: 211,248

[22] PCT Filed: Sep. 18, 1992

[86] PCT No.: PCT/SE92/00646

§ 371 Date: Mar. 17, 1994

§ 102(e) Date: Mar. 17, 1994

[87] PCT Pub. No.: WO93/05874

PCT Pub. Date: Apr. 1, 1992

[30] Foreign Application Priority Data

Sep. 20, 1991 [SE] Sweden ..... 9102736

[51] Int. Cl.[6] ..... B01F 9/00

[52] U.S. Cl. ..... 366/208; 366/239

[58] Field of Search ..... 366/208, 209, 366/215, 216, 239

[56] References Cited

U.S. PATENT DOCUMENTS

| | | | |
|---|---|---|---|
| 2,834,585 | 5/1958 | O'Harenko | 366/209 |
| 3,261,594 | 7/1966 | Michel . | |
| 4,673,297 | 6/1987 | Siczek . | |
| 4,893,938 | 1/1990 | Anderson | 366/208 |

FOREIGN PATENT DOCUMENTS

| | | |
|---|---|---|
| 0419667 | 4/1991 | European Pat. Off. . |
| 2660950 | 10/1991 | France . |
| 2660948 | 10/1991 | France . |
| 2222997 | 3/1990 | United Kingdom . |

*Primary Examiner*—Robert W. Jenkins

*Attorney, Agent, or Firm*—Townsend and Townsend and Crew

[57] ABSTRACT

Devices and methods for the mixing of liquid samples which comprise means for performing the mixing, including a resting phase during the mixing cycle.

5 Claims, 1 Drawing Sheet

MIXING APPARATUS FOR TEST TUBES

Figure 1:
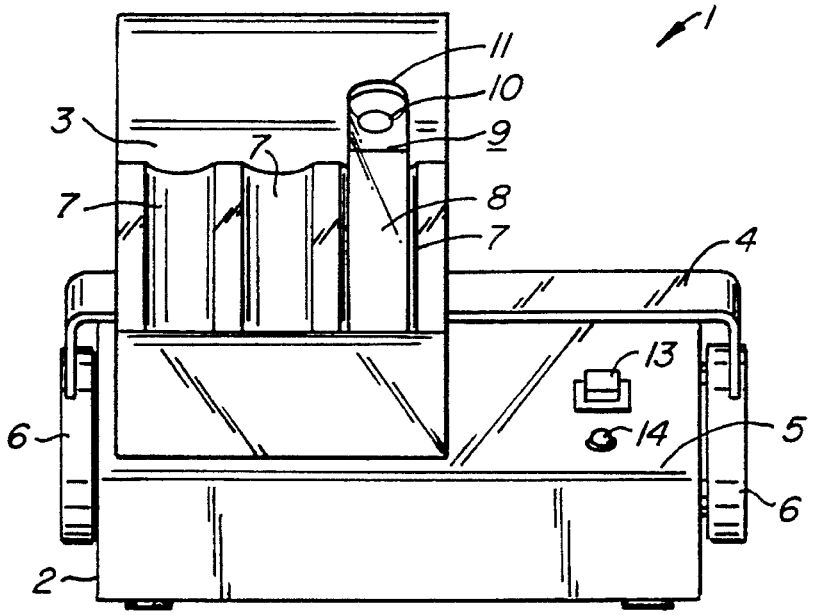

The present invention concerns a test tube mixing apparatus

When obtaining blood samples, the blood is transferred from the patient to a test tube through a cannula to prevent the blood from being unusable it must immediately be mixed with an anticoagulating agent (as e.g. sodium citrate) which stops the otherwise immediately initiated coagulation of the blood. For the mixing to be effective a test tube, e.g. a vacuum tube, has to be slowly turned at least ten times for the air bubble which is present in the test tube to be able to pass the whole length of the tube. The anticoagulating agent contents within the tube then passes and mixes with the blood contents of the tube. The mixing has to date in accomplished manually, which is carried out in such a way that the sampling personell by hand turns the tube the prescribed at least ten times, controlling at the same time that the air bubble each time passes the whole length of the tube, considering that the personnel taking samples often has to collect samples from a large number of patients, the manual mixing has shown to be an ergonomic problem in that sence that the frequent repeating turning movement is very straining for the wrist and the shoulders. At the same time as carrying out the mixing, the sample collector is also occupied with looking after the patient and possibly filling further test tubes. Since the quality of the sample is entirely dependent on the mixing being carried out in a correct manner, lack of concentration of the personnel leads to unusability of a large number of samples, which therefore has to be obtained again. The reason for this may be that the mixing was initiated too late, that the mixing movement was carried out too fast or that the mixing was not carried out a sufficient number of cycles. Taken together this leads to a deterioration of the quality of the results from the analysis or the unusefulness of the sample.

So called rocking mixer devices for test tubes are previously known, c.f. U.S. Pat. No. 3,261,594. This rocking device is, however, firstly suited for mixing immediately prior to analysis of blood samples where the blood cells have been compacted at the bottom of the test tube after storing or transport. For this object the mixing frequency and durability are not particularly critical, why the known device may be involved with parameters that are unsuitable for the mixing in of an anti-coagulating agent. The presence of external means for regulating the frequency, that are present in this device, further comprises a risk factor to the extent that the operator may alter a carefully tested adjustment. Besides, it does not give any indication of a sufficient mixing being carried out as rocking mixer devices of this kind work with an uninterrupted oscillating movement. This known rocking device is further because of its design with e.g. trays for the tubes, directly unsuitable for use at the sample collecting occasion.

In another previously known mixing device the tubes are fixed in a support which is brought to perform a continously rotating movement. This device is besides being impaired with previously known drawbacks also time consuming to handle and is not usable at the sample collecting occasion.

It is an aim with this invention to overcome the above problems and to provide a mixing device for test tubes, which is simple and flexible to handle, which subject the tubes to an accurate mixing movement, gives a safe indication of the mixing process being effected and is possible to realise in such a size that it may be put on a sample collecting carriage and is thereby easily brought by the sample collecting personell on a sample collecting round, preferably without any connection to an external source of current, and is usable directly at the sample collecting occasion.

These and also other aims are achieved with a mixing device in accordance with the features of the present invention.

By thus the mixing tray for receiving the test tubes being subjected to a rocking motion of a prescribed frequency and with a prescribed number of oscillations when started, it is achieved that test tubes that are placed on the mixing tray immediately after the sample collecting occasion are safely subjected to the prescribed mixing process.

Further advantages are achieved by the features according to the dependent claims.

A particularly advantageous mixing movement is achieved when a relatively fast rocking phase is combined with a resting period, where the air bubble being present within the tube has the time to pass the entire length of the tube.

Figure 2:
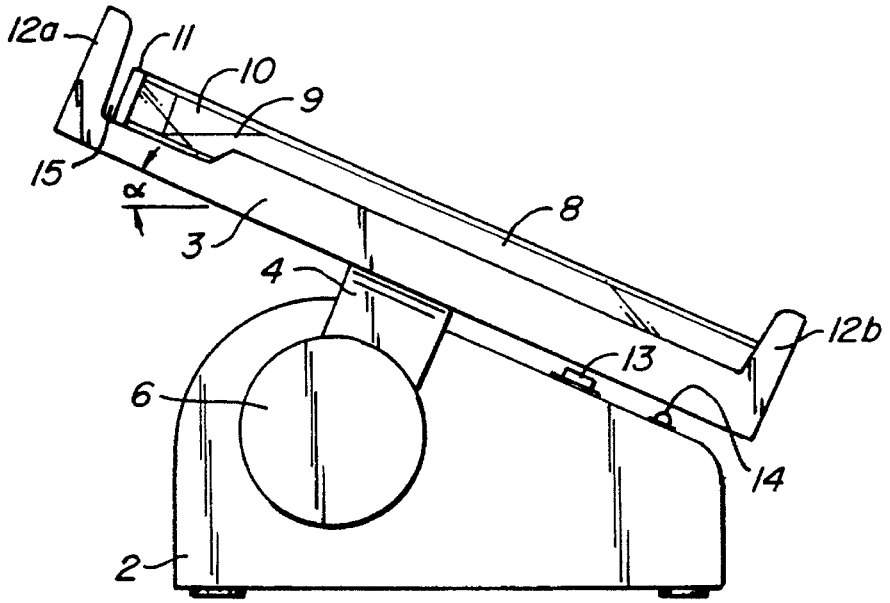
Figure 3:
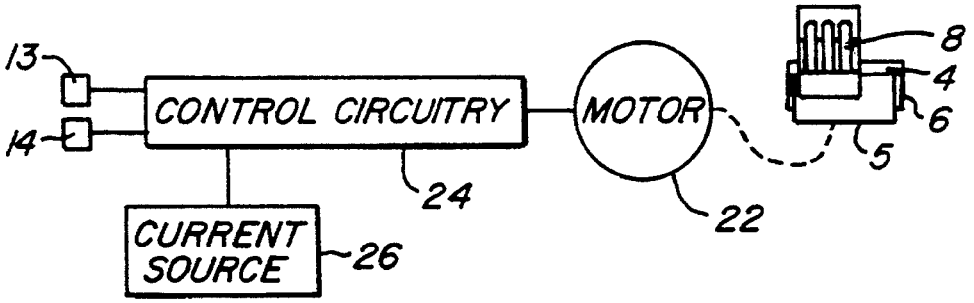

The invention will now be described in greater detail with reference to an embodiment and appended drawings of which FIG. 1 shows a mixing device according to the invention in a front view, FIG. 2 shows the mixing device according to FIG. 1 in a side view, and FIG. 3 shows, in schematic form, the intermittent rocking drive unit drivingly coupled to the mixing tray.

The mixing device 1 according to FIGS. 1, 2 and 3 comprises a base 2 within which a driving means in the form of an electric motor 22 is contained. Within the base there are also comprised control circuitry 24 for controlling the mixing movement as well as a current source 26 as e.g. a rechargeable battery. Above the base a mixing tray is fastened, which is connected to the drive unit in the base 2 through a driving yoke 4, the substantially horizontal portion of which is fixed to the mixing tray 3. The vertical portions of the driving yoke 4 removably cooperate with slots in driving discs 6 being provided on each side of the base, said discs being connected to the drive unit by means of a drive shaft 5. Through the removable cooperation between the driving yoke 4 and the driving discs 6, it is achieved that the driving yoke 4 together with the mixing tray 3, is simply removable from the base 2, which facilitates cleaning and transport of the device. The mixing tray 3 comprises on its upper surface a number of grooves 7 for receiving test tubes 8. The width and the length of the grooves are adjusted so that the mixing device 1 may be used for all test tubes that are available on the market. The test tube 8 shown in FIGS. 1 and 2 is of vacuum type and consists of a glass tube with a plug 11 in its upper portion. Appropriately filled with blood and anticoagulating agent the tube 8 displays a liquid surface 9 immediately below the plug 11, whereby an air bubble 10 is present between the liquid surface and the plug. As is evident from FIG. 2, the mixing tray 3 is comprised with tube stops **12*a* and 12*b* at its ends to prevent the tube from gliding off from the mixing tray in its longitudinal direction. The grooves 7 end at a portion from the upper tube stop 12*a* in the figure, whereby a recess 15** is formed, which facilitates putting in and taking out of test tubes from the mixing tray.

The method of working of the mixing device 1 is as follows. Immediately after that a test tube 8 has been filled with blood from a patient and anticoagulating agent, it is placed on the mixing tray 3 whereafter the sample collector presses the start button 13. The drive unit will then subject the mixing tray 3 to a rocking movement from the position shown in FIG. 2, where the mixing tray is inclined to the left an angle α to the horizontal plane to a position where the mixing tray is inclined with an angle at the other direction (the angel β not shown in the figure), which may be different from or equal to α. The angles may me chosen within the area between 15° and 60°, but are preferably between 25° and 45°. The rocking frequency may easily be tested concerning e.g. the type of test tube to be used, but should as a matter of precaution be so low that sufficient mixing is acheived for the most difficult to mix test tubes, whereby the air bubble being present in the tubes will safely pass the entire length of the tube also for thin long tubes. The frequency will then be in the order of 0.2 to 2 Hz. Particularly good mixing is achieved when the mixing tray stops and rests a certain amount of time in every end position, whereby the air bubble gives the opportunity to rise to the at present upper part of the tube in the resting periods. To achieve an adequate mixing movement where the above mentioned air bubble passes the entire length of all possible tubes in every oscillation, all parameters: frequency, angles of inclination α and β and resting period must be adjusted to each other for the most unfavourable condition. Preferably the position shown in the figures, with an inclination of the mixing tray an angle α is an initial position, which is taken by the tray 3 when it stops.

The number of oscillations being carried out by the mixing device may also be tested, but is preferably within the area around 8–12. Preferably the control circuitries of the mixing device are designed in such a way that a start signal leads to the prescribed number of oscillations being carried out thereafter even if the signal is given while the device is already started. In this way it is unnecessary to wait for a completed mixing cycle since there is no risk of subjecting a tube to mixing too long, only by letting it mix for a too short a time. To further guarantee the function of the apparatus the base 2 preferably is comprised with an indicator lamp 14 in the form of e.g. a light diode, for indication of low charging level of the battery in good time before the stand still of the apparatus due to a discharged battery. The device may also be provided with a circuit for delivering a light or a sound signal indicating a completed mixing cycle. To handle e.g. leaking tubes, manual quick-stop may be arranged in the circuitry. To indicate malfunction it is preferred to have control means delivering e.g. an intermittent light signal when the mixing is not completed.

The invention is not limited to the above described embodiment, but only to what is stated in the claims. Thus the mixing tray 3 may be subjected to a rocking movement of the above mentioned kind by means of any other suitable transmission. The removability of the mixing tray can further be achieved in any other suitable manner, e.g. through loosenable connection with respect to the driving yoke, which in itself is permanently fixed to the base.

It is also possible that for a elimination of missing delivering of the start signal, the drive unit is started by a test tube 8 being placed in a groove 7 of the mixing tray 3. In this case the mixing tray may be provided with any kind of sensing element, which transmits a start signal to the drive unit. In a preferred embodiment the test tubes are provided with a detectable, e.g. magnetized, element, the presence of which is detected by a detecting device on the mixing tray, which then sends a start signal to the drive unit. Said element may be integral with an identification label or put on the test tube in any other way, e.g. as a piece of magnetic tape. The detecting device on the mixing tray may be passive, and thus not consume any energy. If, however, the detecting element is active with a certain current consumption, the device may be provided with control and time circuits aiming to limit the time when the device is in a stand-by position and thereby limit the current consumption.

Alternatively a start signal may be given by pressing down of the mixing tray, the driving yoke or corresponding elements in connection with the placing of the test tube on the mixing tray.

I claim:

1. A mixing device for test tubes, comprising a base with an intermittent rocking drive unit arranged therein and a mixing tray, for receiving test tubes, movably mounted to said base, said intermittent rocking drive unit comprising intermittent drive control circuitry, a motor coupled to and controlled by the control circuitry, the motor drivingly coupled to the mixing tray, said mixing tray being driven by said intermittent rocking drive unit which subjects said mixing tray to an intermittent rocking movement, wherein said intermittent rocking drive unit is constructed and arranged to perform said intermittent rocking movement with a prescribed frequency and a prescribed number of oscillations when started, with a resting period at each end position of said intermittent rocking movement so that each test tube is subjected to a prescribed mixing process.

2. The mixing device of claim 1, wherein the length of said resting period is adjustable and adapted to said prescribed frequency and to the angles of inclination of the mixing tray in said end positions.

3. The mixing device of claim 1, wherein said intermittent rocking drive unit includes driving discs adapted to move a driving yoke which is mounted on either side of said base, wherein said driving yoke is fastened to said mixing tray.

4. The mixing device of claim 1, wherein the drive unit is adapted to perform the prescribed number of oscillations after a start signal has been given, wherein said start signal is given before or after said rocking motion commences.

5. The mixing device of claim 1, wherein said mixing tray has a grooved upward surface sized to receive said test tubes.

* * * * *